US005690508A

United States Patent [19]

Atkinson

[11] Patent Number: 5,690,508

[45] Date of Patent: Nov. 25, 1997

[54] ELECTRICAL CORD PLUG PULLER

[76] Inventor: Stuart Lloyd Atkinson, 2910 6 Ave. North, Saint Petersburg, Fla. 33713

[21] Appl. No.: 619,982

[22] Filed: Mar. 21, 1996

[51] Int. Cl.[6] ..... H01R 13/00

[52] U.S. Cl. ..... 439/484

[58] Field of Search ..... 439/484, 367, 439/369

[56] References Cited

U.S. PATENT DOCUMENTS

| | | | |
|---|---|---|---|
| 3,270,267 | 8/1966 | Nolte, Jr. | 439/484 X |
| 4,210,377 | 7/1980 | LaVogue | 339/45 R |
| 4,307,924 | 12/1981 | Gibbs | 339/110 P |
| 4,619,491 | 10/1986 | Drogo | 339/45 M |
| 5,062,803 | 11/1991 | Howard et al. | 439/160 |
| 5,516,305 | 5/1996 | Haluska | 439/484 |

FOREIGN PATENT DOCUMENTS

| | | |
|---|---|---|
| 2236221 | 3/1991 | United Kingdom . |

*Primary Examiner*—Khiem Nguyen
*Attorney, Agent, or Firm*—John D. Gugliotta

[57] ABSTRACT

An electrical cord plug puller is disclosed for aiding in the removal of plugs from sockets. The plug puller acts as an insulator between the user's hand and plug to eliminate shock occurrences. Main components include a flat cord with 15 pounds of tensile strength, a tie-wrap for securing the plug puller to the plug and its power cord, and a 3 to 6-inch piece of plastic tubing which forms the pull loop. The cord is bent to form two loops, with one situated on each end of the cord, a plug loop and a pull loop. The plug loop is secured to the plug. The user's fingers are placed through the pull loop when pulling the plug from the socket.

2 Claims, 3 Drawing Sheets

ELECTRICAL CORD PLUG PULLER

BACKGROUND OF THE INVENTION

1. Field of the Invention

The present invention relates generally to electrical supply and extension cords and, more particularly, to an apparatus for aiding a user in safely removing stubborn plugs from electrical outlets without damaging the plug or cord.

2. Description of the Related Art

As is well-known in the art, many devices for aiding in removing electrical cord plugs from electrical outlets are known. For example, in U.S. Pat. No. 5,062,803, issued in the name of Howard et al., a plug puller is disclosed formed from a flat, wide flexible strap. Such a plug puller, however, fits over and covers the plug being pulled, thereby creating aesthetic distractions and manipulative interferences.

Also, in U.S. Pat. No. 4,307,924, issued in the name of Gibbs, an electrical plug having integral finger pull and cord grip is disclosed. Such a finger pull, however, utilizes the electrical cord itself for the application of tension to the plug, thereby causing the potential for strain and damage to the cord or plug.

Again, in U.S. Pat. No. 4,210,377, issued in the name of LaVoque, an electrical plug pull is disclosed which again forms a large, flat band which fits over and covers the plug being pulled, thereby creating aesthetic distractions and manipulative interferences.

Another problem which occurs from the use of plug pullers as disclosed in the related art is that such designs are not adaptable for integral embedding into an electrical cord plug.

Consequently, a need has been felt for providing an apparatus and method for preventing strain and damage to an electrical cord plug and which is aesthetically unobtrusive and can be adapted for attachment to or embedding within the electrical cord plug.

SUMMARY OF THE INVENTION

It is therefore an object of the present invention to provide an improved method for preventing strain and damage to an electrical cord plug.

It is another object of the present invention to provide a plug puller which is aesthetically unobtrusive, Further objects of the present invention are to provide a plug puller which can be adapted for attachment to or embedding within the electrical cord plug.

According to one embodiment of the present invention, an electrical cord plug puller is disclosed for aiding in the removal of plugs from sockets. The plug puller attaches to all common power and appliance plugs used throughout the industrialized world, and also attaches to other plugs, such as Centronics™ plugs, which are used on most computer printers. The plug puller acts as an insulator between the user's hand and plug to eliminate shock occurrences. Main components include a flat cord with 15 pounds of tensile strength, a tie-wrap for securing the plug puller to the plug and its power cord, and a 3 to 6-inch piece of plastic tubing which forms the pull loop. The cord is bent to form two loops, with one situated on each end of the cord, a plug loop and a pull loop. The plug loop is secured to the plug. The user's fingers are placed through the pull loop when pulling the plug from the socket.

Advantages of the present invention include easy installation and increased safety over current methods of plug removal, easy and sure plug removal without strain to the cords, and enhancement of removal of plugs from sockets. The present invention may also be modified to make it applicable for other uses through enlargement of the loop or increasing the number of loops.

Further, the present invention is a part of the cord set after it is installed, and will not get lost when the plug is pulled, and can be attached to any type of plug.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

1. Detailed Description of the Figures

Figure 1:
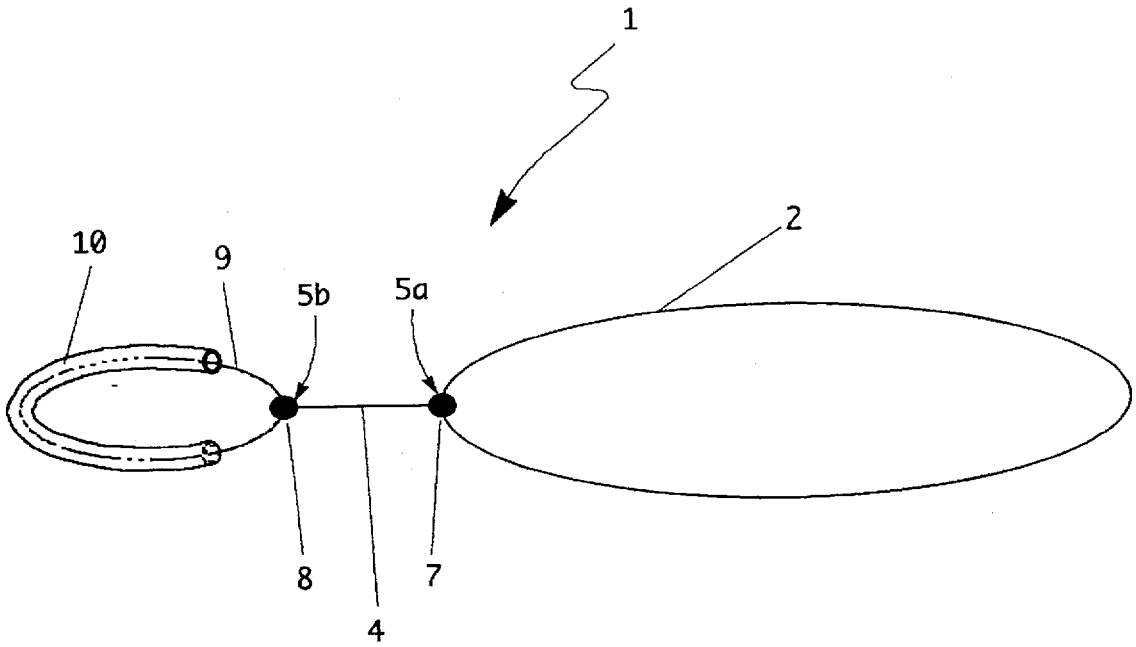
FIG. 1 is a perspective view of an electrical cord plug puller according to the preferred embodiment of the present invention.

Referring now to FIG. 1, an electrical cord plug puller 1, according to the one preferred embodiment of the present invention, depicting a dual fixed loop design. As shown, a cord affixment loop 2 is provided, preferably formed of flat cord or ribbon having a circumference of approximately 10 inches. An elongated extension member 4 having a first end 5*a* and a second end 5*b* is affixed at the first end 5*a* to a first attachment point 7 on the cord affixment loop 2. Although the elongated extension member 4 can be made in many lengths, it is found that an extension member 4 having a length of approximately 2 inches is suitable for use with most standard electrical cord plugs. A second attachment point 8 affixes the second end 5*b* of the extension member 4 to a grasping loop 9, formed similar to the cord affixment loop 2 except having a circumference of approximately 3 inches. Both the first affixment point 7 and the second attachment point 8 form a non-slip, permanent connection between the extension member and the respective loops. The grasping loop 9 is surrounded with a cushioning means 10. In its preferred embodiment it has been found that the cushioning means 10 comprised of a pliable, tubular section of plastic or other similar material is both economical and effective. It is essential to the operation of the present invention that the cord affixment loop, the extension member, the grasp loop, and the combined combination of all three elements be formed of a material such as to have a minimum of 15 pounds of pull strength.

Figure 2:
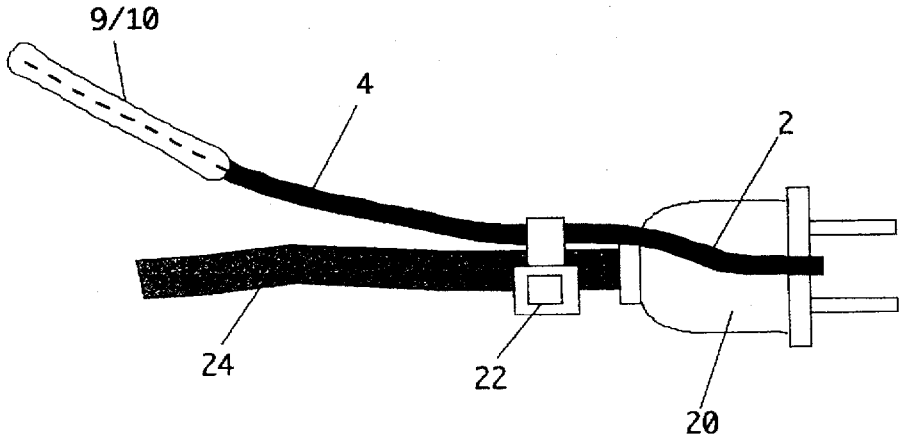
FIG. 2 is a side view thereof shown affixed to an electrical cord plug.

Referring to FIG. 2, the electrical cord plug puller 1 is shown affixed to a standard electrical plug 20. A first attachment means 22 for attaching the plug puller 1 to the electrical cord 24 is utilized, and although other specific devices can function as the first attachment means, as shown a standard plastic tie-wrap is used.

2. Operation of the Preferred Embodiment

The present invention fills a need to make plug removal easier and safer. Plugs today are made in a variety of shapes and sizes. It is a rare plug that is easy to grasp and remove. By using the present invention, all plugs become equally easy to withdraw from a socket. After installing the plug puller 1 around the plug 20 and to the cord 24, plug removal from an outlet is accomplished by pulling the plug puller 1. As the population ages and disabilities such as arthritis become more prevalent, this product does everybody a favor by making plug removal easier. Safety is also increased in that the urge to pull directly upon the cord 24 in order to remove the plug 20 is eliminated.

Figure 3A:
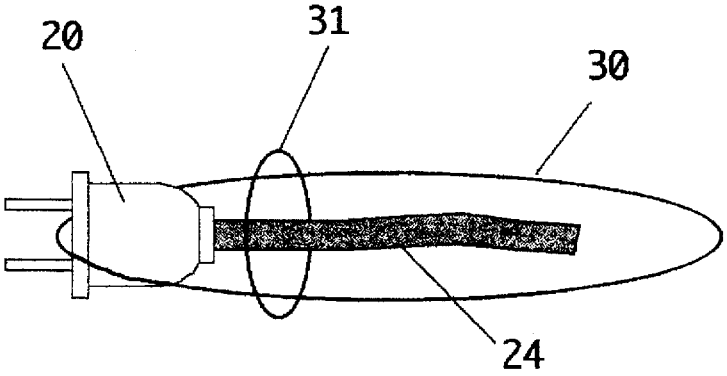
FIG. 3*a* is a schematic of a first alternate embodiment for an electrical cord plug puller.

The foregoing description is included to illustrate the operation of the preferred embodiment and is not meant to limit the scope of the invention. Many alternate embodiments are envisioned within the scope of the present disclosure. For example, as shown in FIG. 3*a*, a first alternate embodiment is shown utilizing a single continuous loop 30 wrapped around the plug 20, and affixed to the cord 24 by a fastener 31. The fastener 31 is required to secure the loop 30 to its plug and cord, and assures the loop 30 remains attached, especially when the plug is not installed in a socket. The fastener 31 also crimps the loop 30 to the back of the plug 20 assuring proper pull alignment of the loop 30 with the body of the plug 20. The fastener is a simple loop of material that pulls the loop 30 tight against the plug 20, and can be made of the same material as the loop 30, or could also be a conventional nylon tie-wrap.

Figure 3B:
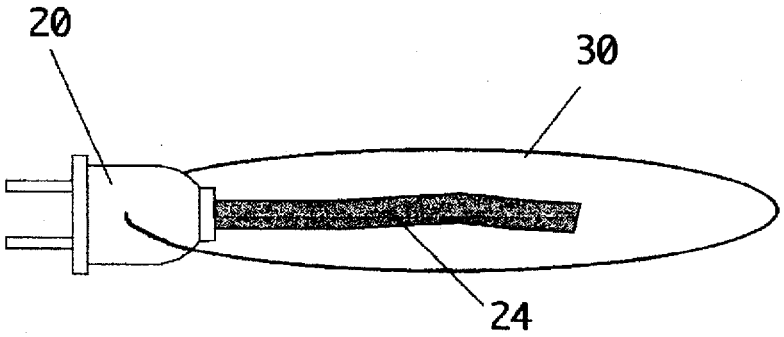
FIG. 3*b* is a schematic of a second alternate embodiment for an electrical cord plug puller.

As shown in FIG. 3*b*, a second alternate embodiment is disclosed in which a single continuous loop 30 is embedded within the structure of the plug body 20. Such an embodiment would be incorporated into the plug during the manufacture of the plug.

Figure 3C:
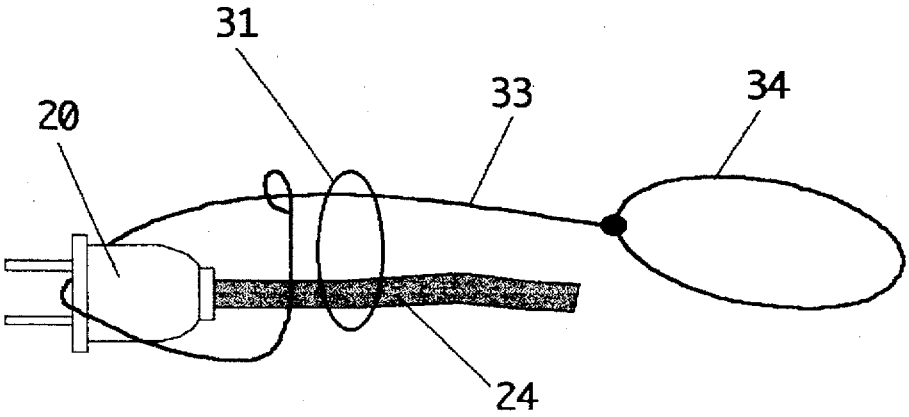
FIG. 3*c* is a schematic of a third alternate embodiment for an electrical cord plug puller.

As shown in FIG. 3*c*, a slip loop 33 is provided at one end for encircling the plug 20. A pull loop 34 is affixed at the other end of the slip loop 33 to facilitate grasping. A fastener 31 can also be used with this embodiment to assure that the slip loop 33 remains secure and reasonably tight after each pull.

Figure 3D:
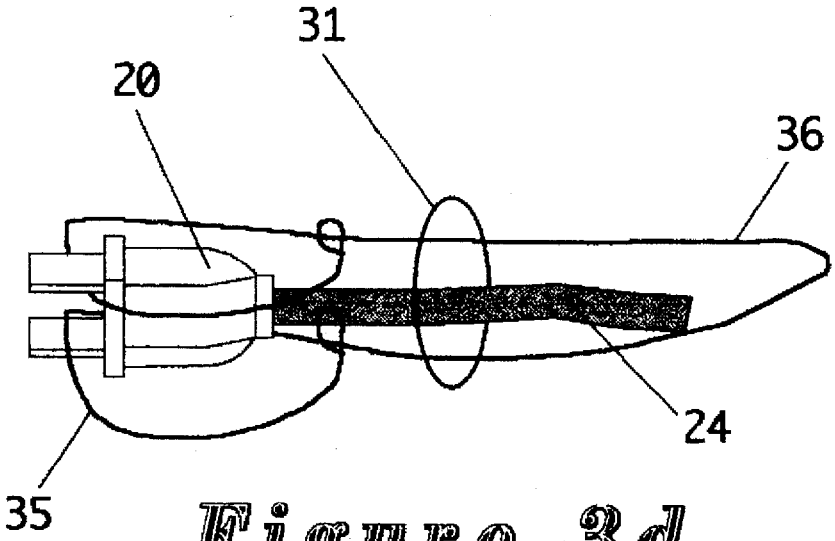
FIG. 3*d* is a schematic of a fourth alternate embodiment for an electrical cord plug puller.

As shown in FIG. 3*d*, a pair of slip loops 35 are provided which are attached to the plug 20. The slip loops 35 are at opposite ends of a pull section 36. The slip loops 35 are both attached to the plug 20 with the remainder forming the pull section 36. A fastener 31 is also used to secure the pull section 36 to the cord 24.

Figure 3E:
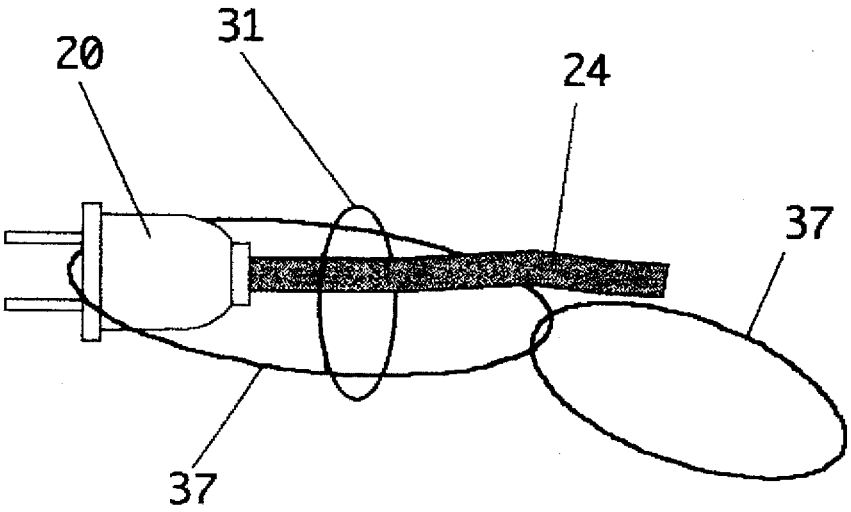
FIG. 3*e* is a schematic of a fifth alternate embodiment for an electrical cord plug puller.

As shown in FIG. 3*e*, two or more loops 37, each made of the same material, are interlocked to each other forming a chain type arrangement. One loop is placed around a plug 20 between the blades or prongs. A fastener 31 is again used to keep the attached loop in the proper position.

There are many other embodiments that can be formed utilizing the teachings of the present disclosure. Many specific examples are disclosed, but many other arrangements are possible utilizing both the teachings of the present disclosure, as well as a combination of the specific embodiments disclosed. Therefore, the scope of the invention is to be limited only by the following claims.

What is claimed is:

1. An electrical cord plug puller suitable for use with most standard electrical cord plugs, said electrical cord plug puller comprising:

a cord affixment loop formed of flat cord:

an elongated extension member having a first end and a second end said first end affixed to said cord affixment loop at a first attachment point:

a gasping loop formed of a flat cord, said grasping loop affixed to said second end of said extension member at a second attachment point; and cushioning means for surrounding said grasping loop wherein said cushioning means comprises of a pliable, tubular section of plastic material;

and wherein:

said cord affixment loop, said extension member, said grasp loop, and the combined combination of all three elements together have a minimum of 15 pounds of pull strength.

2. The electrical cord plug puller as described in claim 1, wherein said cord affixment loop is permanently embedded within the body of an electrical cord plug.

* * * * *